United States Patent [19]

Barr

[11] 4,382,477

[45] May 10, 1983

[54] ROTARY DRILL BITS

[75] Inventor: John D. Barr, Gloucester, England

[73] Assignee: Drilling & Service U.K. Limited, Gloucester, England

[21] Appl. No.: 223,836

[22] Filed: Jan. 9, 1981

[30] Foreign Application Priority Data

Jan. 10, 1980 [GB] United Kingdom ..... 8000606
Mar. 6, 1980 [GB] United Kingdom ..... 8007686

[51] Int. Cl.[3] ..... E21B 10/46

[52] U.S. Cl. ..... 175/410; 175/375; 407/40; 407/48

[58] Field of Search ..... 175/374, 375, 409, 410; 407/8–10, 40, 47, 48; 408/713, 714, 144, 204

[56] References Cited

U.S. PATENT DOCUMENTS

| | | | |
|---|---|---|---|
| 2,889,138 | 6/1959 | Haglund | 175/410 X |
| 3,168,925 | 2/1965 | Gayley | 175/410 |
| 3,311,181 | 3/1967 | Fowler | 175/410 |
| 3,342,531 | 9/1967 | Krekeler | 175/410 |
| 3,362,489 | 1/1968 | Miller | 175/413 |
| 3,603,414 | 9/1971 | Stebley | 175/374 |
| 3,618,683 | 11/1971 | Hughes | 175/410 |
| 3,697,137 | 10/1972 | Krekeler | 299/86 |
| 3,717,209 | 2/1973 | Sheldon et al. | 175/413 |
| 3,745,623 | 7/1973 | Wentorf, Jr. et al. | 29/95 |
| 3,771,612 | 11/1973 | Adcock | 175/413 |
| 4,108,260 | 8/1978 | Bozarth | 175/374 |
| 4,148,368 | 4/1979 | Evans | 175/410 X |
| 4,156,329 | 5/1979 | Daniels et al. | 51/295 |
| 4,168,923 | 9/1979 | Vezirian | 175/410 X |
| 4,199,035 | 4/1980 | Thompson | 175/410 |
| 4,271,917 | 6/1981 | Sahley | 175/410 |

FOREIGN PATENT DOCUMENTS 1340987 9/1963 France .

*Primary Examiner*—Stephen J. Novosad
*Assistant Examiner*—Thuy M. Bui
*Attorney, Agent, or Firm*—Cushman, Darby & Cushman

[57] ABSTRACT

In a rotary drilling bit having preform cutting elements, a partial or total structural discontinuity is disposed between the elements and the underlying structure or within the underlying structure to reduce the bending strain upon the preform cutting elements. In this way there is a reduction in the fracture or damage of preform cutting elements.

17 Claims, 12 Drawing Figures

ROTARY DRILL BITS

BACKGROUND AND SUMMARY OF THE INVENTION

The invention relates to rotary drill bits for use in drilling or coring deep holes in subsurface formations and, in particular, to a drilling bit comprising a bit body with a shank and an inner channel for supplying drilling fluid to the face of the bit. The bit body carries a plurality of so-called "preform" cutting elements. The preforms are shaped items of hard material and may be moulded of hard abrasive particles or of a hard homogeneous material. For example, they can be moulded of particles of natural or synthetic diamond, secondary abrasive particles and metal bonding agents. The preforms often comprise a thin diamond facing layer and a thicker cemented tungsten carbide backing layer. This construction provides a degree of self-sharpening in that, as the preform wears away in use, the tungsten carbide layer wears away more easily than the diamond layer. The preforms are usally mounted on or in the rotary drill bit by being bonded, e.g. brazed, to a support member which may be of steel or a matrix of tungsten carbide particles infilled with a metal alloy or of cemented tungsten carbide. The use of such preforms, their manufacture and mounting on rotary drill bits are disclosed in the following U.S. patents, the disclosure of all of which is herein incorporated by this reference: U.S. Pat. Nos. 3,743,489; 3,745,623; 3,767,371; 4,098,362; 4,109,737; 4,156,329. Preforms may also be made of boron carbide, boron nitride, titanium diboride, silicon nitride or mixtures thereof or of "Sialon" or of other extremely hard material. Typically the particles of abrasive material in the preform are large so that the preform cutting element can act along one edge, i.e. a cutting edge.

In use the cutting forces cause bending stresses in preforms mounted on deep hole rock drilling bits. Where the drilling is being carried out in non-homogeneous formation, inclusions of hard material in the formation can increase the cutting forces and hence the stresses. The value of the bending stress in the preform depends partly on the deflection of the material on which it is mounted. The bending stress is sometimes sufficient to fracture the preform, particularly if the formation contains inclusions of hard material. This problem may be reduced by mounting the preforms on more rigid supports of material having a high modulus of elasticity such as cemented tungsten carbide. For example, each preform may be brazed to an underlying support stud of cemented tungsten carbide mounted on a tool body of steel or matrix. Such an arrangement reduces bending deflection and can prevent fracture of the preform but gives rise to other disadvantages which arise because materials of high modulus of elasticity are normally hard and relatively wear resistant. As the preform wears down, the hard material of the underlying support begins to rub on the formation behind the cutting edge. This increases the normal force required to achieve a given depth of cut and the resulting friction force is added to the tangential cutting force, increasing the specific energy, i.e. the energy required to drill a unit volume of formation. Heat is also generated near the cutter and this heat may weaken the brazed joints securing the preforms to the supports and damage the diamond layer. One result of this is that the rate of penetration of a drill bit is reduced as the cutters become worn, and the specific energy increases.

It is an object of this invention to provide a rotary drill bit for deep hole drilling or coring including preform cutter elements which are mounted on the bit in such a manner as to reduce the bending stresses in the preforms generated by deflection of the supports, thereby permitting the use of relatively soft and/or thin supports. This tends to avoid the above-mentioned disadvantages of using supports of high rigidity and, therefore, high wear resistance, and also reduces the cost of manufacture of the bit.

According to one aspect of the invention there is provided a rotary drilling bit for deep hole drilling or coring in subsurface formations comprising a body with a shank having a fluid bore, the body carrying a plurality of preform cutting elements and support members characterised by the presence of a total or partial structural discontinuity disposed and arranged to reduce the bending strain in the preform cutting elements caused by deflection of the support member in use of the bit.

In a known bit, a preform cutting element bonded to a solid support element will be constrained by the bond to suffer deformation along the bond surface nearly equal to that occurring near the bond surface in the support member due to strain in the support material caused by the cutting forces. The presence of the partial or total structural discontinuity reduces this constraint and/or its effect.

In use, the preform cutting element has a cutting edge. The structural discontinuity is preferably disposed and arranged in the structural link between the preform cutting element and the underlying structure relative to the cutting edge such that the remainder of the preform can more easily move away from the underlying structure. In this way the geometry of the preform cutting element is isolated from deformations of the support member in use of the bit. The remaining linkage between the preform cutting element and the underlying structure must be sufficient to hold the element to the structure while the discontinuity must be sufficient to allow the structure to deform without causing damaging deflection in the preform cutting element. In practice, the total or partial structural discontinuity consists of a gap between the facing surfaces of the preform cutting element and the underlying structure which may be either closed or open depending on whether the surfaces are in contact or not. Where the surfaces are in contact, the discontinuity has a high compressive strength but low tensile and shear strengths. (A bonded, brazed or welded joint between two surfaces which is intended to remain intact is not considered to be a discontinuity in this context, but a temporary bond which can be allowed to fracture in use is included within the scope of the invention if other means are provided to retain the preform.) Where the structural discontinuity is partial, it may consist of one or more slots or holes.

In one preferred aspect, the preform cutting element is loosely mounted on the support member, i.e. the structural discontinuity is total, and elastic locating means are present to hold the preform to the support member. In another preferred aspect, the preform is secured, e.g. by brazing, to the support or to an intermediate backing member forming part of a support assembly including one or more total or partial structural discontinuities to reduce the effect on the preform of elastic (or inelastic) deformations of parts of the support member.

Where the cutting element is loosely mounted on the support member, the locating means is arranged so that loads imparted to the preform during use of the tool are transmitted to the support member, the locating means being arranged to permit limited movement of the preform as a whole relative to the support member. The cutting forces which may be temporarily increased by impact loads or hard inclusions in the formation cause deformation of the support member but the preform will move relative to the support as it deflects and there will be a reduction in the bending stresses which would otherwise be imposed on the preform. As a result—and this is a particular advantage of the invention—use may be made of a support structured of a material which has a lower wear resistance, e.g. of steel and/or a support which is thinner than usual. In both cases, frictional forces are reduced.

In one embodiment, one end of an elongate locating means is fixed to the bit body at a position spaced from the support and the other end abuts the cutting face of the preform cutting element. Preferably the locating means comprises an elongate resilient metal strip and preferably two such strips are used. The locating means may take the form of a leaf spring. The support assembly preferably further includes additional means to locate the preform on the support to prevent translatory movement of the preform along the fixed surface of the support. The additional means may include a pocket formed in the support member, the sides of which partially enclose the preform. The additional locating means may also include a projection extending from one surface into the other while permitting relative movement between the surfaces in a direction normal thereto. For example, the projection may comprise a peg formed separately from both the preform and the support and, optionally, secured to one of them.

In any of the above arrangements, the support and the retaining element may be provided as a sub-assembly for attachment to the bit body. For example, the sub-assembly may be in the form of a stud to be received in a socket formed in the bit body. The stud may be formed in at least two separately formed abutting parts, at least one of which parts may be wedge-shaped whereby the stud may, in use, be wedged within the socket in the bit body.

In another preferred feature of the invention, the preform is mounted on a support assembly comprising a backing element and locating means which comprises a resilient member connecting the backing element to the bit body. In such an arrangement the movement of the preform as a whole is permitted by deflection of the connecting member, and since the preform is not directly connected to the support, there will be a reduction in the bending stresses which would otherwise be imposed on the preform by deflections of the support. Preferably the resilient connecting member is stiffer in directions parallel to the front surface of the preform than it is in a direction normal to the front surface of the preform.

The backing element and resilient connecting member may be integrally formed with one another, and they may also be integrally formed with the support.

The backing element, resilient connecting member and support may be provided as a sub-assembly for attachment to the bit body. For example, the sub-assembly may be in the form of a stud to be received in a socket formed in the bit body. The stud may be formed in at least two separately formed abutting parts, at least one of which parts may be wedge-shaped whereby the stud may, in use, be wedged in the socket in the bit body.

According to another preferred feature of the invention, the support assembly includes one or more slot(s) and/or one or more aperture(s) so shaped and positioned in relation to the preform as to modify the deformation of the portion adjacent the preform under cutting loads, in a manner to reduce the tensile and/or bending stresses which would otherwise be included in the preform by said deformation. Where the preform is bonded to a surface of the support this arrangement may also serve to reduce tensile and/or shear stresses in the bond. The slot(s) and/or aperture(s) may be formed wholly in the material of the support or, alternatively, the aperture may be formed by a recess in the surface of the support against which the preform is located, so that the walls of the aperture are defined partly by the material of the support and partly by the rear surface of the preform. The slot(s) and/or aperture(s) preferably extend(s) through the support, preferably substantially parallel to the front surface of the preform.

The invention includes a method of mounting a preform cutter element on a bit as described together with the sub-assemblies herein disclosed.

DETAILED DESCRIPTION OF THE DRAWINGS

In the following description, the same references used to describe the different embodiments indicate the same parts.

Figure 1A:
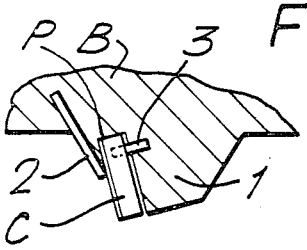
FIG. 1*a* and 1*b* are sectional and front elevational views, respectively, diagramatically illustrating exemplary preform cutting elements according to the present invention.
Figure 1B:
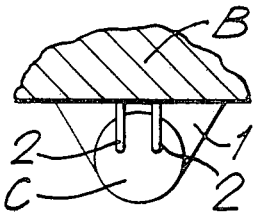

In the embodiment of FIGS. 1*a* and 1*b*, a disc-shaped preform cutting element C is located in a semi-circular pocket P on a support surface 1 of the body of a drilling bit B. Two holes are drilled at an angle into the bit B a short distance from the support surface 1. Within these holes are located elongate metal rods 2 such that the free ends thereof abut the exposed face of the preform C. A short hole is present in the rear face of the preform C to receive a peg 3 extending from a hole in the support surface 1. There is a small annular gap between the peg 3 and the hole in the preform C. In use, a loose preform C is fitted into the pocket P by reception of the peg 3 in the hole of the support 1 and then the rods 2 are fitted in place. In this way the preform C is held to the support 1. When the drill bit is rotated for example to drill a hole in soft formation and a harder piece of formation is struck, the cutting force or impact load causes elastic deformation of the support 1 and this deformation tends to lift the upper part of the preform C from the support 1 without however damaging either of these parts. If the preform C were simply brazed to the support surface 1 there is a risk that the deformation would fracture the preform or the braze.

Figure 2:
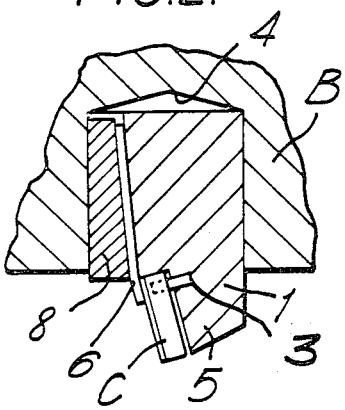
FIG. 2 is a sectional view of one exemplary preform cutting element according to the present invention.

In the embodiment of FIG. 2, a socket 4 in the drill bit B receives a support stud assembly 5. The stud 5 comprises a support 1 and a complementary wedge part 8 and they mate in wedging manner to receive between them the end of a leaf spring 6 a portion of which extends to abut the preform C. This preform C is held to the support 1 by a peg 3 but is able to move away from the support when the latter deflects under stresses generated in use of the bit.

Figure 3:
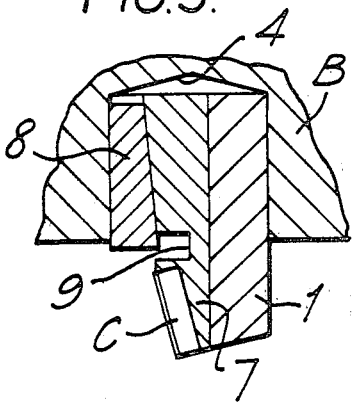
FIG. 3 is a view like FIG. 2 of another exemplary preform cutting element.

In the embodiment of FIG. 3, the preform C is brazed in a recess in the backing element 7 of a backing member assembly 7, 8, 9, 10. The element 10 of the backing member abuts the support 1 and these are wedged by a wedge member 8 in the socket 4 of a bit B. The backing member includes a neck 9 shaped to resist lateral movement of the preform C relative to the bit B. The discontinuity between the backing element 7 and the support 1 allows relative movement and reduces the effect on the preform C of deformation of the support 1 thus permitting the support 1 to be made of a softer material and/or smaller section. This wears away more easily and reduces friction, saving energy and reducing the heat generated. This is true even when the support 1 and the element 10 are integrally formed.

Figure 4A:
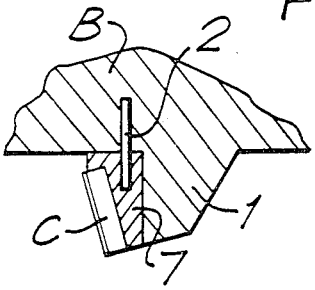
FIGS. 4*a* and 4*b* are a sectional and front elevational view, respectively, of another embodiment of an exemplary preform cutting element according to the present invention.
Figure 4B:
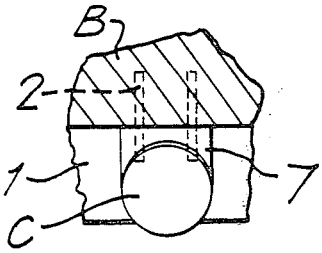

In the embodiment of FIGS. 4*a* and 4*b*, the preform C is brazed to a backing element 7 which is abutted against a support surface 1. Two rods 2 extend from aligned holes in the bit body B and the backing element 7 the rods 2 holding the preform C in position and isolating the preform C from deformations imposed on the support 1 in use of the drilling bit.

Figure 5:
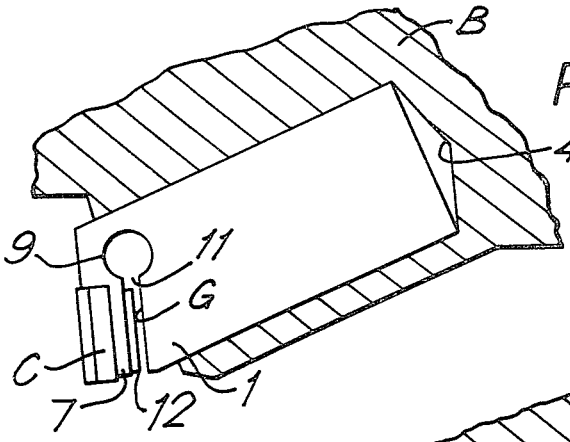
FIGS. 5, 6, 7, 8, and 9*a* are diagramatic cross-sectional views, with the support surface or support assembly shown in elevation, of further embodiments of different preform cutting elements according to the present invention.

In the embodiment of FIG. 5 a semi-circular or part-circular preform cutting element C is bonded to a backing element 7 which is preferably integrally formed with the flexible neck 9 and the support member 1. A slot 11 is formed between the element 7 and the support member 1 and an intermediate spacer 12 is provided to transmit the cutting forces from the backing element 7 to the support member 1. (Although a gap G is shown for clarity, the spacer 12 is preferably normally in contact with the support 1.) The discontinuity between the spacer 12 and the support 1 reduces the effect on the preform C of deformation of the support 1 and permits the support 1 to be made of a material softer than cemented tungsten carbide (e.g. steel) giving the same benefits as the previous embodiments.

Figure 6:
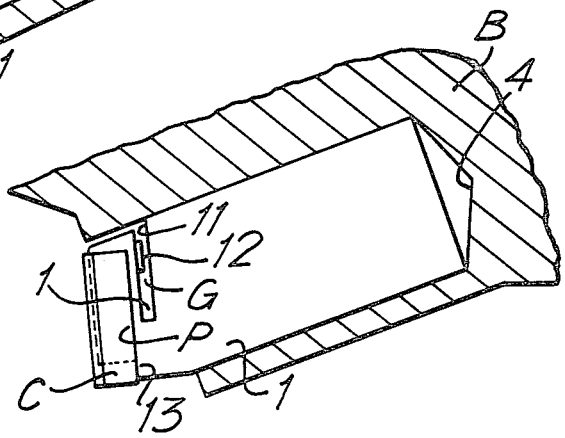

In the embodiment of FIG. 6, the circular preform cutting element C is bonded into a pocket P in the support element 1 which incorporates a partial structural discontinuity in the form of a slot 11. A spacer 12 is preferably but not necessarily present in the slot 11 to reduce vibration and deflection from near vertical forces, particularly when the cutter is partly worn. Cutting forces and horizontal impact forces cause deformation of the support member 1 which, without the slot 11, would cause curvature of the bond surface 13 between the preform C and the facing wall of the pocket P and bending and tension in the preform C. The slot permits the gap G to open, and a reduction in the bending and tensile strains in the preform C.

Figure 7:
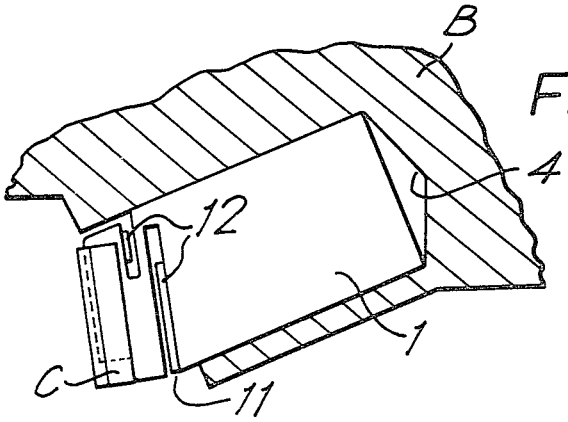

The embodiment of FIG. 7 incorporates the feature of the embodiments of FIGS. 5 and 6 and is designed to ensure that the advantages of the invention are obtained as the cutting edge of the preform cutting element C is worn away. When the drilling bit is new, it behaves like the embodiment of FIG. 5. As the preform C and the support 1 wear away, the behaviour approaches that of the embodiment of FIG. 6.

Figure 8:
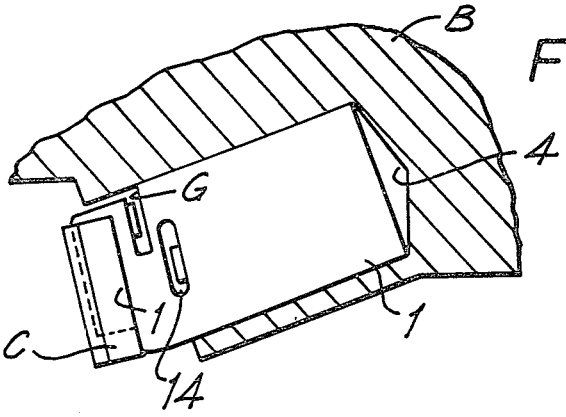

In the embodiment of FIG. 8 the lower slot is replaced by a hole or aperture 14 which provides a structural discontinuity to reduce the rigidity of that part of the support 1 behind the central region of the preform C, thus reducing the bending forces transmitted to the preform when the support 1 is deformed by the cutting forces.

Figure 9A:
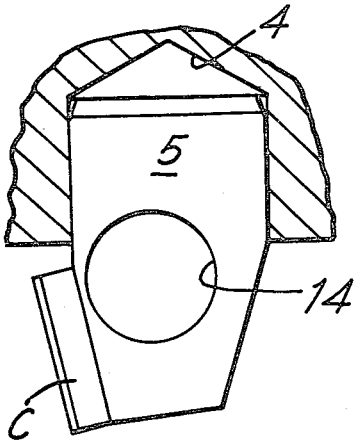
Figure 9B:
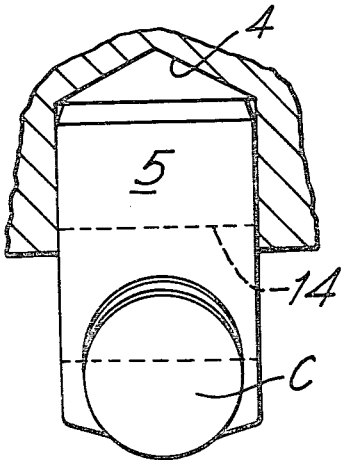
FIG. 9*b* is a front elevational view of the preform cutting element of FIG. 9*a*.

In the embodiment of FIGS. 9*a* and 9*b* the preform C is brazed to one end of a support peg 5, the other end of which is received in a socket 4 in a bit body B. A hole 14 extends through the thickness of the peg 5 substantially parallel to the front surface of the preform C. The hole 14 provides a structural discontinuity to reduce the rigidity of that part of the support 1 behind the central region of the preform C, thus reducing the bending forces transmitted to the preform C when the support 1 is deformed by the cutting forces. More than one hole 14 may be present and the hole may be of any suitable cross-sectional shape. The hole may be disposed adjacent to the braze bond line. The percentage reduction of stress in the preform cutter provided by the embodiment of FIGS. 9*a* and 9*b* will depend on the particular shape and location of the hole but it is found in practice that a reduction of stress in the cutter of as little as 20% is worthwhile if it prevents fracture. Similar reductions in stress have been achieved, with steel pegs, by increasing the size of the pegs in relation to the size of the cutters, but such arrangements increase resistance to the operation of a worn bit, the cost, the distances between cutters and interfere with the efficiency of the hydraulics associated with the cutters.

I claim:

1. A rotary drill bit for deep hole drilling or coring in subsurface formations comprising a body with a shank having a fluid bore, said body carrying a plurality of preform cutting elements and support members, in which each preform cutting element is loosely mounted in contact with the respective support member and flexible locating means are provided to hold the preform cutting element in contact with the support member and to reduce the bending strain in the preform cutting element caused by deflection of the support member in use of the bit, in which the flexible locating means comprises an elongate locating means one end of which is fixed to the bit body at a position spaced from the support member and the other end of which urges the preform towards the support member.

2. A bit according to claim 1, in which the flexible locating means comprises a leaf spring.

3. A bit according to claim 1, in which the fixed end of the locating means is wedged between two separable parts, one of which defines the support for the preform cutting element.

4. A bit according to claim 1, including additional means to locate the cutting element on the support member to prevent translatory movement of the preform cutting element along a fixed surface of the support.

5. A bit according to claim 1, including additional means to locate the cutting element on the respective support member to prevent rotation of the preform cutting element in the plane of its cutting surface.

6. A bit according to claim 4, in which the additional means comprises a peg formed separately from both the element and the support and secured to one of them.

7. A bit according to claim 1, adapted to receive a detachable support including the preform cutting element.

8. A bit according to claim 7, including a socket adapted to receive a stud to which is secured the preform cutting element.

9. A rotary drill bit for deep hole drilling or coring in subsurface formations comprising a body with a shank having a fluid bore, said body carrying a plurality of preform cutting elements and support members in which each preform cutting element is loosely mounted in contact with the respective support member and flexible locating means are provided to hold the preform cutting element in contact with the support member and to reduce the bending strain in the preform cutting element caused by deflection of the support member in use of the bit, in which the preform cutting element is bonded to a backing element which is loosely mounted in contact with the support member and the flexible locating means is arranged to hold the backing element in contact with the support member.

10. A bit according to claim 9, in which the flexible locating means comprises a neck integral with the backing element.

11. A bit according to claim 9, in which the flexible locating means comprises elongate elastic rods extending between the bit body and the backing element.

12. A bit according to claim 9, in which the flexible locating means is integral both with the backing element and with the support member.

13. A bit according to claim 9, adapted to receive a detachable support including the preform cutting element.

14. A bit according to claim 13, including a socket adapted to receive a stud to which is secured the preform cutting element.

15. A rotary drill bit for deep hole drilling or coring in subsurface formations comprising a body with a shank having a fluid bore, said body carrying a plurality of preform cutting elements and support members, in which each preform cutting element is loosely mounted in contact with the respective support member, and in which at least one slot or aperture is provided extending parallel to the major face of the preform to reduce the bending strain in the cutting element caused by deflection of the support member in use of the bit.

16. A bit according to claim 15, adapted to receive a detachable support including the preform cutting element.

17. A bit according to claim 15, in which the bit includes a socket adapted to receive a stud to which is secured the preform cutting element.

* * * * *